US005517290A

United States Patent [19]

Marumoto et al.

[11] Patent Number: 5,517,290

[45] Date of Patent: May 14, 1996

[54] ADJUSTABLE TRANSFER BELT UNIT IN AN IMAGE-FORMING MACHINE

[75] Inventors: Takeshi Marumoto; Tsuyoshi Koyanagi; Kazuya Kamidaira, all of Osaka, Japan

[73] Assignee: Mita Industrial Co., Ltd., Osaka, Japan

[21] Appl. No.: 277,998

[22] Filed: Jul. 20, 1994

[30] Foreign Application Priority Data

Aug. 23, 1993 [JP] Japan ..... 5-207367
Aug. 31, 1993 [JP] Japan ..... 5-214712

[51] Int. Cl.[6] ..... G03G 13/14; G03G 21/10

[52] U.S. Cl. ..... 355/271; 355/299

[58] Field of Search ..... 355/271, 272, 355/273, 274, 275, 296, 299; 430/126

[56] References Cited

U.S. PATENT DOCUMENTS

| | | | |
|---|---|---|---|
| 4,788,572 | 11/1988 | Slayton . | |
| 4,931,839 | 6/1990 | Tompkins et al. | 355/271 X |
| 4,984,026 | 1/1991 | Nishise et al. | 355/271 X |
| 5,107,303 | 4/1992 | Miyamoto et al. | 355/296 |
| 5,175,589 | 12/1992 | Kimura | 355/271 |
| 5,182,602 | 1/1993 | Kakita et al. | 355/271 |
| 5,189,478 | 2/1993 | Hara et al. | 355/271 |
| 5,196,893 | 3/1993 | Nishise et al. | 355/271 |
| 5,247,334 | 9/1993 | Miyakawa et al. | 355/271 |
| 5,262,832 | 11/1993 | Takeda | 355/326 R |
| 5,270,783 | 12/1993 | Bisaiji et al. | 355/246 |
| 5,291,252 | 3/1994 | Kawaishi | 355/272 |
| 5,335,052 | 8/1994 | Sato et al. | 355/271 |

FOREIGN PATENT DOCUMENTS 4-345183 12/1992 Japan .

*Primary Examiner*—R. L. Moses
*Attorney, Agent, or Firm*—Beveridge, DeGrandi, Weilacher & Young

[57] ABSTRACT

A transfer belt unit in an image-forming machine comprising a transfer roller which is disposed being opposed to an image carrier with a transfer belt interposed therebetween and is rotatably supported at both ends by a support member, and a moving means which moves said transfer roller toward said image carrier up to a first position where said transfer belt is pushed onto said image carrier, and moves said transfer roller in a direction opposite to said image carrier up to a second position where said transfer belt is separated away from said image carrier.

12 Claims, 10 Drawing Sheets

ADJUSTABLE TRANSFER BELT UNIT IN AN IMAGE-FORMING MACHINE

FIELD OF THE INVENTION

The present invention relates to a transfer belt unit employed in an image-forming machine such as an electrophotographic apparatus and an electrostatic recording apparatus. More specifically, the invention relates to a transfer belt unit in an image-forming machine which transfers the toner image formed on an image carrier onto a transfer paper and conveys the transfer paper onto which the toner image has been transferred.

DESCRIPTION OF THE PRIOR ART

The image-forming machine of this type usually employs a transfer system in which the corona discharge is used for transferring the toner image formed on an image carrier onto a transfer paper. However, the transfer system using the corona discharge has problems in that transfer performance is inferior in a highly humid environment and that defective transfer is apt to occur due to contamination on the corona wires and wrinkles in the transfer paper.

In order to solve such problems, Japanese Laid-Open Patent Publication No. 345183/1992 discloses a transfer system in which a transfer/conveyer unit is disposed being opposed to the image carrier, the transfer/conveyer unit comprising a drive roller, a driven roller arranged in parallel with, and spaced from, the drive roller, a transfer/conveyer belt wrapped round the drive roller and the driven roller, and a transfer roller disposed opposed to the image carrier with the transfer/conveyer belt interposed therebetween, and in which the transfer roller is electrically charged with a high voltage, so that the toner images formed on the surface of the image carrier are sequentially attracted by, and are transferred onto, the transfer paper that is fed to between the image carrier and the transfer belt.

In such a transfer belt system, the transfer/conveyer belt develops defects such as permanent deformation of the belt when it is left to stay press-contacted to the image carrier at all times, causing the transfer performance to be deteriorated. In order to solve this problem, therefore, the transfer/conveyer unit has been so constituted as to turn on the drive shaft as a center. That is, during the transfer operation, the transfer/conveyer unit is urged by a spring toward the side of the image carrier and when the transfer operation is not being carried out, the transfer/conveyer unit is separated away from the image carrier against the force of the spring.

SUMMARY OF THE INVENTION

Provision of a cleaning unit is indispensable for the transfer belt system to remove the toner from the transfer belt. The cleaning unit is desirably so constituted that a cleaning blade is pushed onto the transfer belt. However, according to the above-mentioned prior art in which the cleaning blade is pushed onto the transfer belt at all times and consequently, the transfer belt undergoes permanent deformation or the cleaning blade itself is deformed, making it difficult to produce a desired function to a sufficient degree.

Moreover, the transfer roller has usually a length in the axial direction that corresponds to the greatest size of the transfer paper that is used. Even when the image is transferred onto a transfer paper of a small size, therefore, the transfer belt is pushed onto the image carrier up to the portions where no transfer paper exists, permitting the toner adhered to the image carrier to be further adhered onto the transfer belt so that the transfer belt is contaminated. This is undesirable.

A principal object of the present invention is to provide a transfer belt unit in an image-forming machine which is capable of removing contact pressure between the transfer belt and the cleaning blade in the case where the transfer belt is separated away from the image carrier when the transfer operation is not being carried out.

Another object of the present invention is to provide a transfer belt unit in an image-forming machine which minimizes the contamination on the transfer belt caused by the toner transferred from the image carrier, enables the cleaning unit to bear a reduced burden, and maintains the cleaning performance for extended periods of time.

In order to achieve the above-mentioned principal object of the present invention, there is provided a transfer belt unit in an image-forming machine which comprises a drive roller, a driven roller disposed in parallel with, and spaced from, said drive roller, a transfer belt wrapped round said drive roller and said driven roller, and a cleaning blade disposed in contact with the surface of said transfer belt, and which transfers the toner image formed on an image carrier onto a copying paper that is fed to between a transfer belt and said image carrier and conveys the transfer paper onto which the toner image has been transferred, wherein the transfer belt unit further comprises:

a transfer roller which is opposed to said image carrier with said transfer belt interposed therebetween and is rotatably supported at its both ends by a support member; and a moving means which moves said transfer roller toward said image carrier up to a first position where said transfer belt is pushed onto said image carrier member, and moves said transfer roller in a direction opposite to said image carrier up to a second position where said transfer belt is separated away from said image carrier.

In order to achieve the above-mentioned another object of the present invention, furthermore, there is provided a transfer belt unit in an image-forming machine which comprises a drive roller, a driven roller disposed in parallel with, and spaced from, said drive roller, and a transfer belt wrapped round said drive roller and said driven roller, and which transfers the toner image formed on an image carrier onto a copying paper that is fed to between a transfer belt and said image carrier and conveys the transfer paper onto which the toner image has been transferred, wherein the transfer belt unit further comprises:

a transfer roller unit having a roller support member that is disposed being opposed to said image carrier with said transfer belt interposed therebetween, and a transfer roller made up of two rollers that are supported by said roller support member on the same axis in a manner of being opposed to each other and being allowed to rotate and slide in the axial direction;

a roller length-changing means which moves at least one of said rollers in the axial direction; and a control unit that drives to control said roller length-changing means to accord with the size of the transfer paper at the time of transfer operation.

According to the present invention, furthermore, there is provided a transfer belt unit in an image-forming machine which comprises a drive roller, a driven roller disposed in parallel with said drive roller maintaining a distance, a transfer belt wrapped round said drive roller and said driven roller, and a cleaning blade disposed in contact with the surface of said transfer belt, and which transfers the toner image formed on an image carrier onto a copying paper that is fed to between a transfer belt and said image carrier and conveys the transfer paper onto which the toner image has been transferred, wherein the transfer belt unit further comprises:

a transfer roller unit having a roller support member that is disposed being opposed to said image carrier with said transfer belt interposed therebetween, and a transfer roller made up of two rollers that are supported by said roller support member on the same axis in a manner of being opposed to each other and being allowed to rotate and slide in the axial direction;

a roller length-changing means which moves at least one of said rollers in the axial direction;

a moving means which moves said transfer roller unit toward said image carrier up to a first position where said transfer belt is pushed onto said image carrier member, and moves said transfer roller unit in a direction opposite to said image carrier up to a second position where said transfer belt is separated away from said image carrier; and a control unit which, when the transfer operation is being carried out, drives to control said roller length-changing means to accord with the size of the transfer paper, drives said moving means so that said transfer roller unit is moved to said first position and, when the transfer operation is not carried out, drives said moving means so that said transfer roller unit is moved to said second position.

The other objects and features of the present invention will become obvious from the following description.

DETAILED DESCRIPTION OF THE PREFERRED EMBODIMENTS

The transfer belt unit in an image-forming machine constituted according to the present invention will be described in further detail by way of preferred embodiments with reference to the accompanying drawings.

Figure 1:
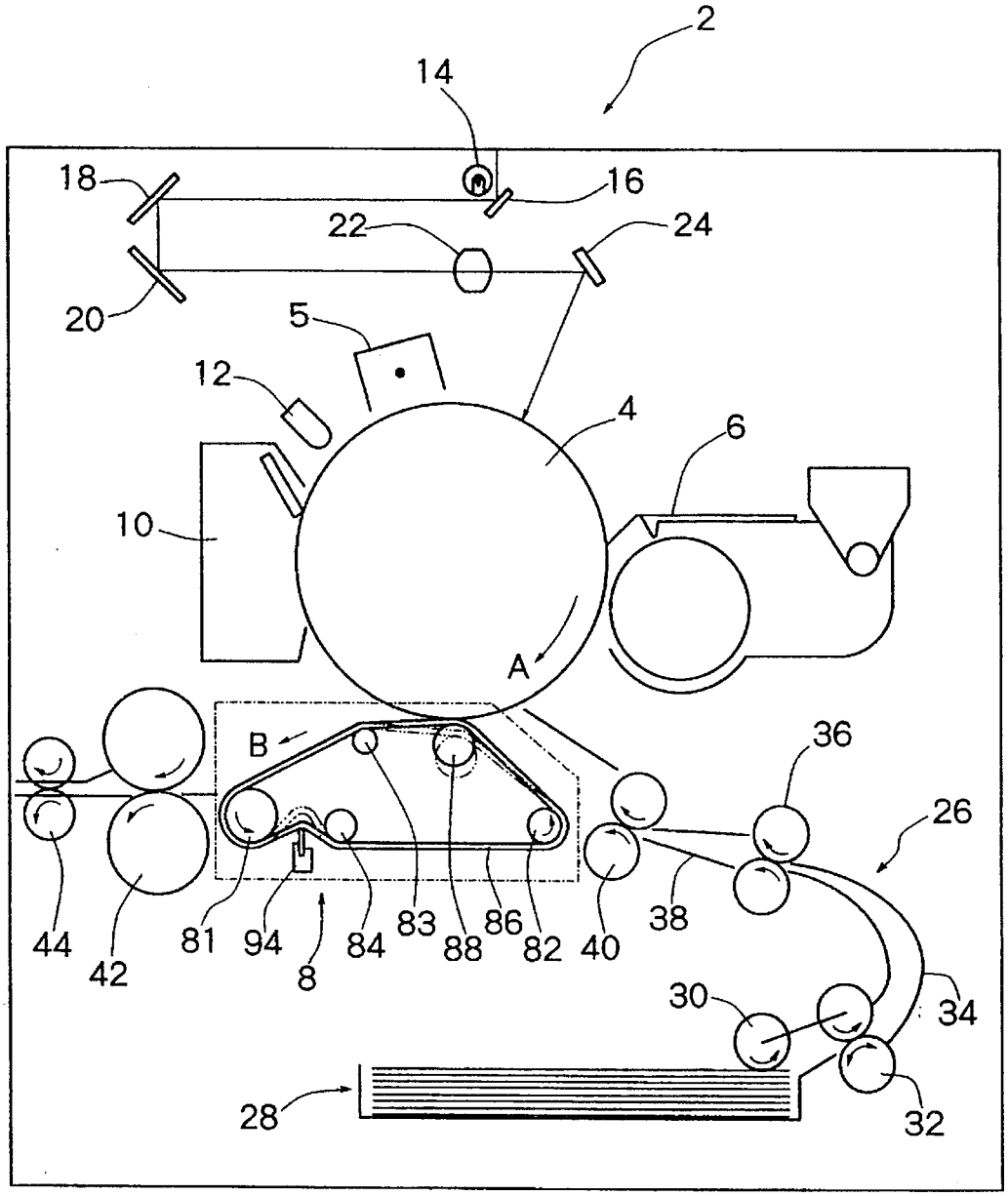
FIG. 1 is a schematical view illustrating the constitution of an image-forming machine equipped with a transfer belt unit according to an embodiment of the present invention.
Figure 2:
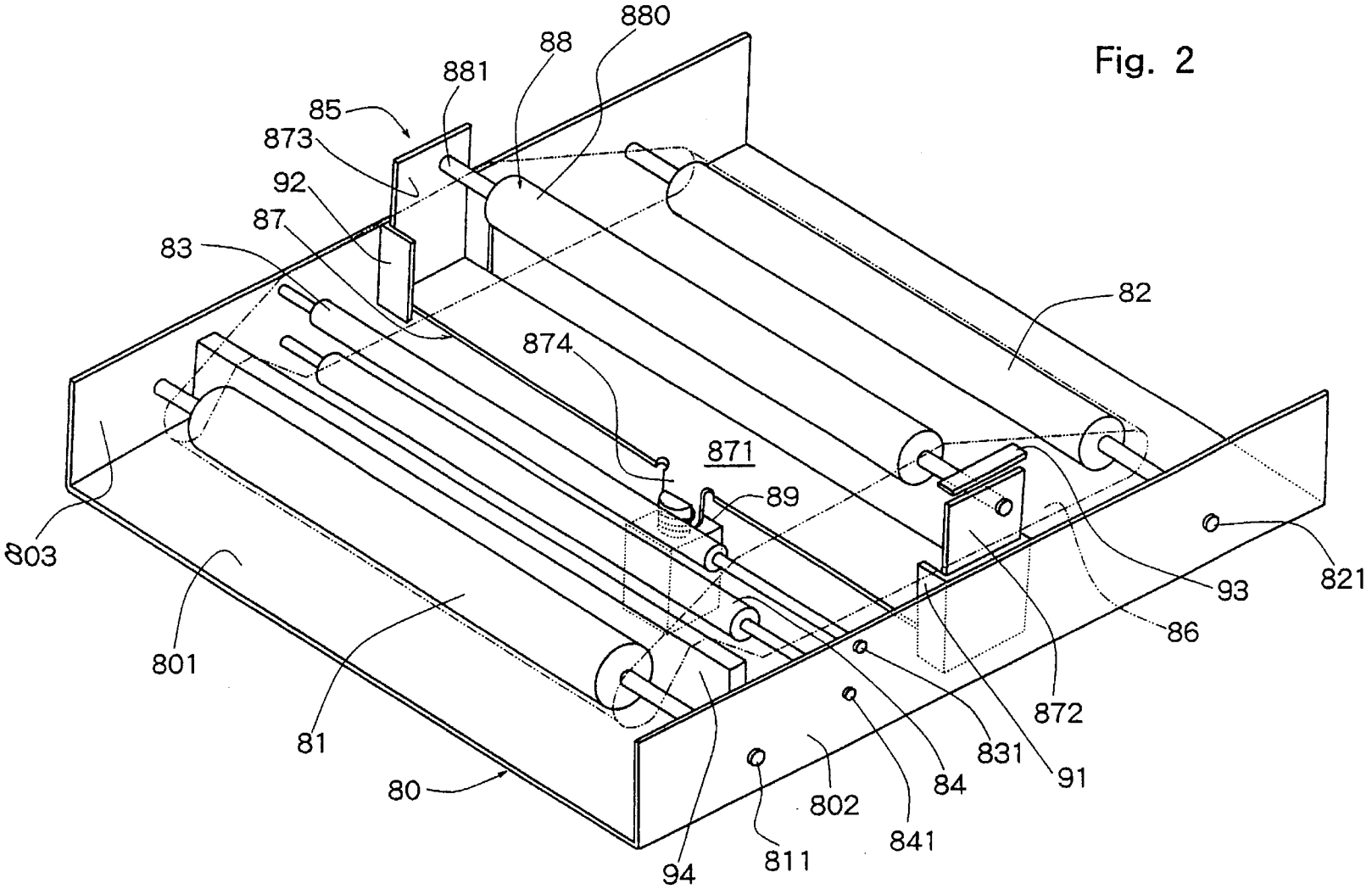
FIG. 2 is a perspective view of the transfer belt unit according to the embodiment of the present invention which is employed in the image-forming machine of FIG. 1.
Figure 3:
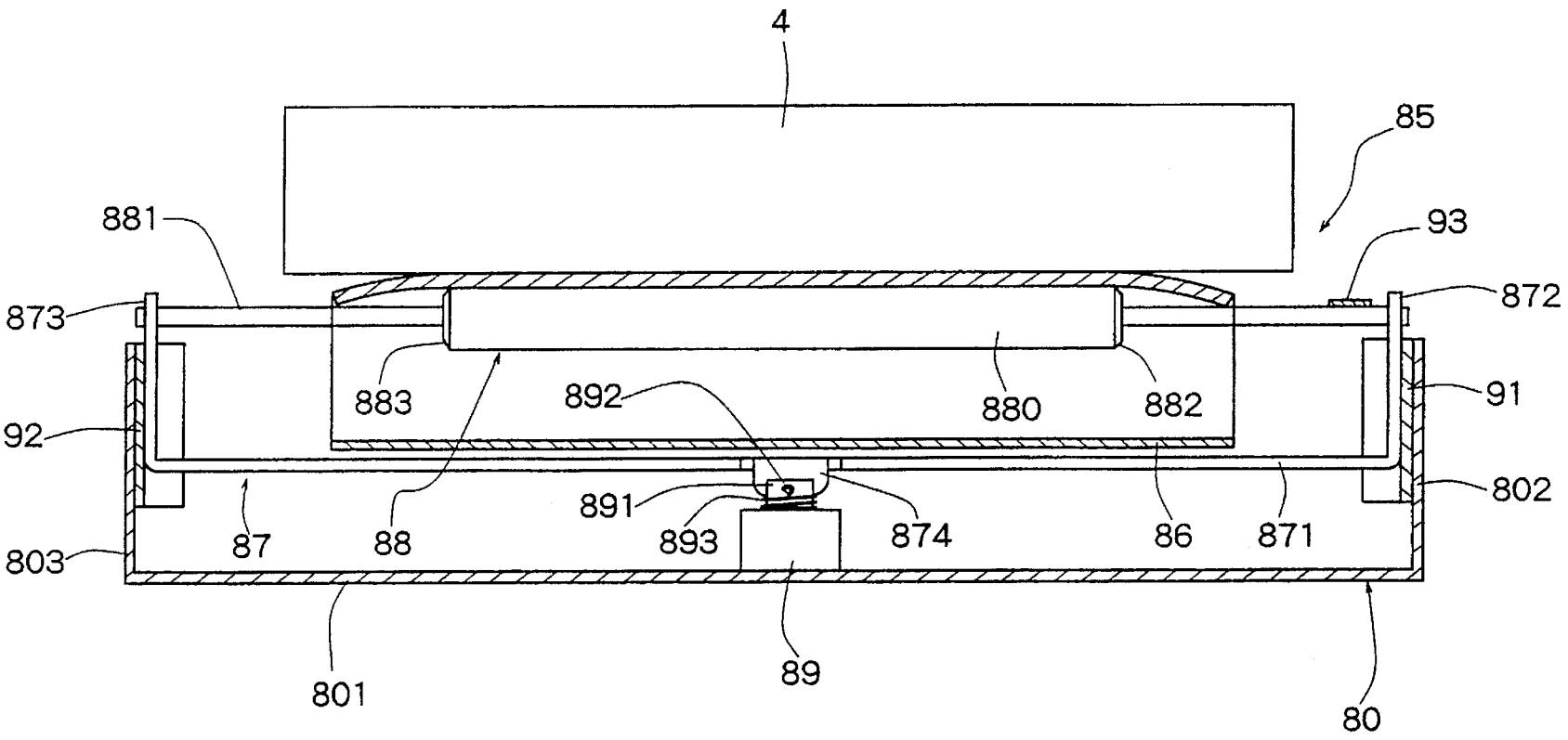
FIG. 3 is a sectional view of major portions illustrating a relationship between the transfer belt unit and the image carrier according to the present invention of FIG. 2.

First, described below with reference to FIGS. 1 to 3 is the transfer belt unit in the image-forming machine according to an embodiment of the present invention.

The image-forming machine 2 shown in FIG. 1 is provided with an image carrier 4 which is a photosensitive drum that is rotatably mounted. As viewed in a direction of rotation indicated by arrow A, the image carrier 4 is surrounded by a corona discharger 5 for electric charging, a developer 6, a transfer belt unit 8 constituted according to the present invention, a cleaning unit 10, and a discharging lamp 12. The illustrated image-forming machine 2 is provided with an optical system that is disposed above the image carrier 4, and comprises an illumination lamp 14, a first mirror 16, a second mirror 18, a third mirror 20, a lens 22 and a fourth mirror 24. The illumination lamp 14 in the optical system illuminates a document placed on a document-placing transparent plate that is not shown, and the reflected light image thereof is focused on the image carrier 4 via the first mirror 16, second mirror 18, third mirror 20, lens 22 and fourth mirror 24.

The image-forming machine 2 is provided with a transfer paper feeding unit 26 for feeding a transfer paper to the transfer belt unit 8. The transfer paper feeding unit 26 is provided with a transfer paper cassette 28 for accommodating transfer papers, a transfer paper delivery roller 30, a pair of paper-feed rollers 32, a guide passage 34, a pair of conveyer rollers 36, a guide passage 38, and a pair of resist rollers. Here, though only one transfer paper cassette 28 is shown in this FIG. 1, there is employed a widely-known transfer paper cassette unit equipped with a plurality of cassettes for accommodating the transfer papers of the sizes of A3, A4, A5, B4, B5, etc. Furthermore, a pair of fixing rollers 42 and a pair of discharge rollers 44 are disposed on the transfer paper delivery side of the transfer belt unit 8.

In the thus constituted image-forming machine 2, while the image carrier 4 is rotated in the direction of arrow A, the corona discharger 5 electrically charges the photosensitive material on the image carrier 4 to a particular polarity substantially uniformly and, then, the illumination lamp 14 illuminates the document that is placed on the document-placing transparent plate that is not shown, and the reflected light bearing the image thereof falls on the image carrier 4 via the first mirror 16, second mirror 18, third mirror 20, lens 22 and fourth mirror 24, so that an electrostatic latent image is formed on the image carrier 4. Thereafter, the electrostatic latent image on the image carrier 4 is developed into a toner image by the developer 6.

On the other hand, the transfer paper accommodated in the transfer paper cassette 28 of the transfer paper feeding unit 26 is delivered by the transfer paper delivery roller 30 and is conveyed to the transfer belt unit 8 passing through the pair of feed rollers 32, guide passage 34, pair of conveyer rollers 36, guide passage 38 and pair of resist rollers 40. Onto the transfer paper conveyed to the transfer belt unit 8 is transferred the toner image as it passes through between the image carrier 4 on which the toner image has been formed and a transfer belt that will be mentioned later, of the transfer belt unit 8. The transfer paper then passes through the pair of fixing rollers 42 where the toner image is fixed, and is then discharged through the pair of discharge rollers 44.

After the step of transferring the image has been completed, as described above, the image carrier 4 rotates to the cleaning unit 10 where the toner adhered to the surface of the photosensitive material is removed and, then, the electric charge on the surface of the photosensitive material is discharge by irradiation with the discharging light from the discharging lamp 12.

The transfer belt unit 8 will now be described with reference to FIGS. 2 and 3.

The transfer belt unit 8 that is shown comprises a unit base plate 80 secured to a housing that is not shown, of the image-forming machine 2, a drive roller 81 mounted on the unit base plate 80, a driven roller 82, a guide roller 83, a guide roller 84, a transfer roller unit 85, and a transfer belt 86 that wrapped round these rollers. The unit base plate 80 has a bottom portion 801 and side portions 802 and 803 formed by upwardly bending both ends of the bottom portion 801. The drive roller 81 is rotatably supported with its rotary shaft 811 that is supported, via bearings that are not shown, by the side portions 802 and 803 of the unit base plate 80. The rotary shaft 811 of the drive roller 81 is coupled to an electric motor that is not shown via a power transmission mechanism such as a gear mechanism that is not shown and is driven thereby. The driven roller 82 is disposed in parallel with the drive roller 81 while maintaining a predetermined distance, and a drive shaft 821 thereof is rotatably supported, via bearings that are not shown, by the side portions 802 and 803 of the unit base plate 80. The guide rollers 83 and 84 are disposed between the drive roller 81 and the driven roller 82 in parallel therewith at a high position and at a low position, and rotary shafts 831 and 841 thereof are rotatably supported, via bearings that are not shown, by the side portions 802 and 803 of the unit base plate 80.

The transfer roller unit 85 comprises a support member 87, a transfer roller 88 mounted on the support member 87, and a solenoid device 89 which is a drive source of a moving means that moves the support member 87 and the transfer roller 88 up and down. The bottom portion 871 has side portions 872 and 873 formed by upwardly bending both ends of the bottom portion 871, and further has a coupling portion 874 formed by downwardly bending the central portion in the lengthwise direction of the bottom portion 871.

The support member 87 is disposed between guide plates 91 and 92 having a channel-shape in cross section which are mounted on the inner surface of the side portions 802 and 803 of the base plate 80, and is allowed to move up and down along the guide plates 91 and 92.

The transfer roller 88 is made from an electrically conducting material and is disposed under the image carrier 4 while being opposed thereto, and a rotary shaft 881 thereof is rotatably supported, via bearings that are not shown, by the side portions 872 and 873 of the support member 87. At a transfer position that is shown, the rotary shaft 881 of the transfer roller 88 comes into contact with an electrode plate 93 that is connected to a high-voltage power source that is not shown. A roller portion 880 of the transfer roller 88 has a length which is smaller than the width of the transfer belt 86, and its both ends are chamfered as designated at 882 and 883.

The solenoid device 89 is mounted on the bottom portion 801 of the base plate 80 and its plunger 891 is coupled by a pin 892 to the coupling portion 874 of the support member 87. The pin 892 is set in a direction at right angles with the axial direction of the transfer roller 88 and, hence, the support member 87 and the transfer roller 88 are allowed to swivel on the pin 892 as a fulcrum. The solenoid device 89 has a tension coil spring 893 disposed between the case thereof and the pin 892. When de-energized, the solenoid device 89 pulls the support member 87 downwards by action of the coil spring 893 and when energized, the solenoid device 89 pushes up the support member 87 against the force of the coil spring 893. When energized, therefore, the solenoid device 89 moves the transfer roller 88 via the support member 87 toward the image carrier 4 up to a first position where the transfer belt 86 is pushed onto the image carrier 4 and when de-energized, the solenoid device 89 moves the transfer roller 88 in a direction opposite to the image carrier 4 up to a second position where the transfer belt 86 is separated away from the image carrier 4.

The transfer belt 86 is formed from a semiconductor material in an endless shape, and is wrapped round the drive roller 81, driven roller 82, guide roller 83, guide roller 84 and transfer roller 88 as shown in the drawing, and is driven by the drive roller 81 in a direction indicated by arrow B at a peripheral speed which is nearly equal to the rotational peripheral speed of the image carrier 4.

In the drawings, reference numeral 94 indicates a cleaning blade which is mounted on the base plate 80 and is disposed between the drive roller 81 and the guide roller 84. The upper end of the cleaning blade 94 is brought into contact with the surface of the transfer belt 86. The cleaning blade 94 is so set that the tension of the transfer belt 86 is best suited for the cleaning operation in a state where the support member 87 and the transfer roller 88 are pushed upwards and the transfer belt 86 is pushed onto the image carrier 4.

Described below is the operation of thus-constituted transfer belt unit of the image-forming machine according to the embodiment.

During the transfer operation, the solenoid device 89 is energized whereby the support member 87 is pushed up against the force of the coil spring 893, and the transfer roller 88 mounted on the support member 87 pushes the transfer belt 86 onto the image carrier 4. In a state where the transfer roller 88 is pushed up and is located at the transfer position that is shown, the rotary shaft 881 of the transfer roller 88 comes in contact with the electrode plate 93 and a high voltage is applied to the transfer roller 88 from the electrode plate 93. When a transfer paper is fed to between the image carrier 4 and the transfer belt 86, therefore, the toner images formed on the surface of the image carrier 4 are sequentially attracted by, and are transferred onto, the transfer paper by the action of the electric charge of the transfer roller 88 at the transfer portion where the image carrier 4 and the transfer roller 88 are opposed to each other. The transfer paper onto which the toner image has been transferred is carried by the transfer belt 86, fixed by the pair of fixing rollers 42, and is discharged from the pair of discharge rollers 44. The toner adhered on the surface of the transfer belt 86 is removed by the cleaning blade 94 as it travels in the direction of arrow B.

When the transfer operation is not carried out, the solenoid device 89 is de-energized, whereby the support member is pulled down by the force of the coil spring 893, and the transfer roller 88 mounted on the support member 87 is moved downwards as indicated by a two-dot chain line in FIG. 1. Therefore, the transfer belt 86 is separated away from the image carrier 4, the tension is loosened, and the contact pressure between the transfer belt 86 and the cleaning blade 94 is removed.

In the transfer belt unit of this embodiment, as described above, the transfer roller 88 only is pulled down when the transfer operation is not carried out. When the transfer roller 88 is pulled down, the transfer belt 86 separates away from the image carrier 4 and its tension is loosened. Therefore, the contact pressure between the transfer belt 86 and the cleaning blade 94 is removed. This makes it possible to prevent the transfer belt from being permanently deformed and to prevent the cleaning blade from being deformed that are attributed to the state that the cleaning blade 94 is pushed onto the transfer belt 86 at all times. According to the illustrated embodiment, furthermore, the support member 87 mounting the transfer roller 88 is pivotally coupled to the plunger 891 of the solenoid device 89 by the pin 892 that is disposed at the central portion in the axial direction of the transfer roller 88 at right angles with the axial direction thereof. In a state of being pushed up by the solenoid device 89, therefore, the pushing force of the transfer roller 88 is uniformly exerted onto the transfer belt 86 and onto the image carrier 4 over the full length in the axial direction thereof, making it possible to prevent irregularity in the transfer of image. According to the illustrated embodiment, furthermore, the transfer roller 88 has a length in the axial direction thereof that is smaller than the width of the transfer belt 86, and no electric current leaks from the transfer roller 88 to the image carrier 4. According to the illustrated embodiment, both ends of the transfer roller 88 are chamfered as designated at 882 and 883, and the transfer belt 86 is bent at its both ends along the chamfered portions 882 and 883 and is, hence, prevented from travelling in a zig-zag manner.

Figure 4:
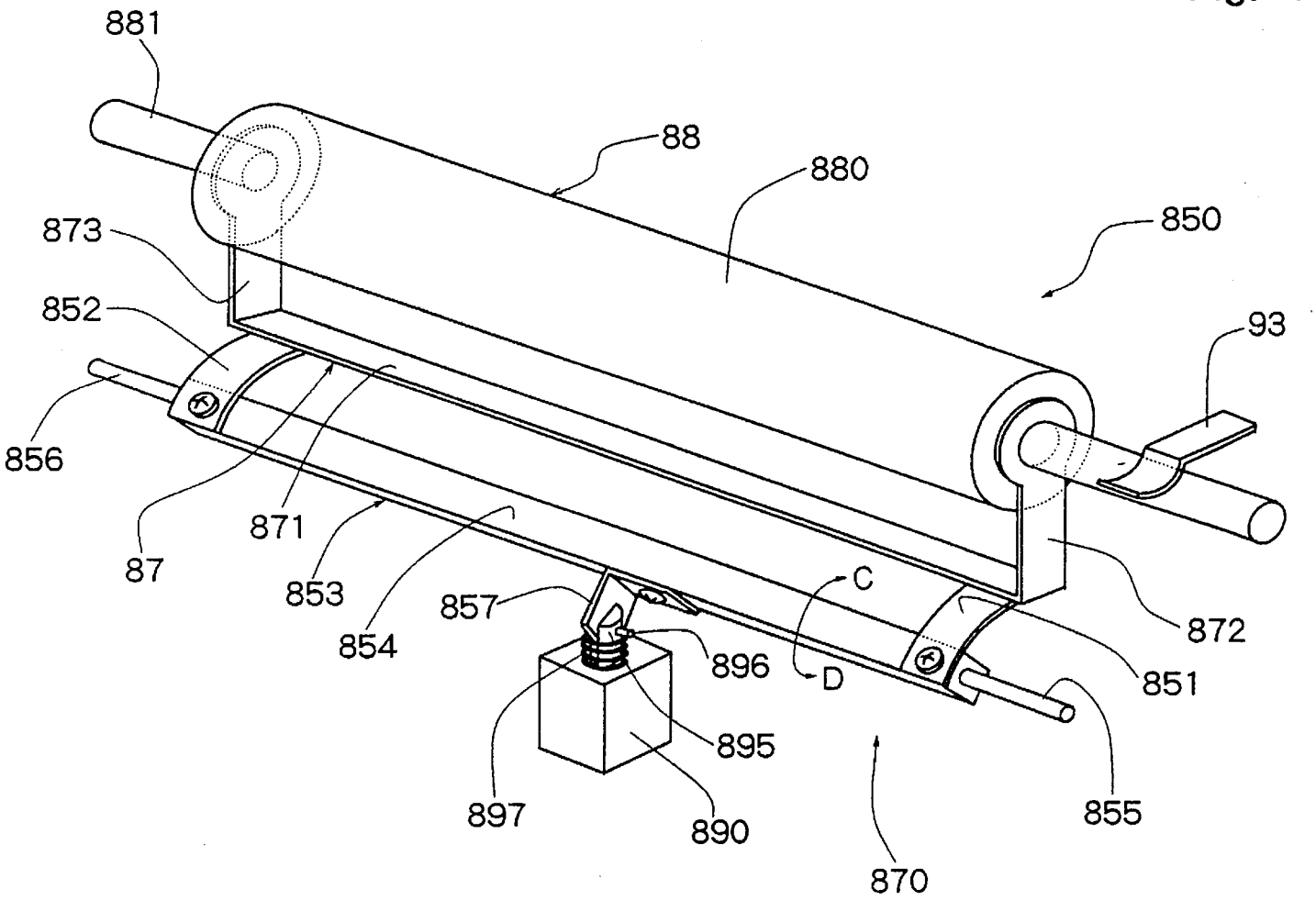
FIG. 4 is a perspective view of a transfer roller unit constituting the transfer belt unit according to another embodiment of the present invention.
Figure 5:
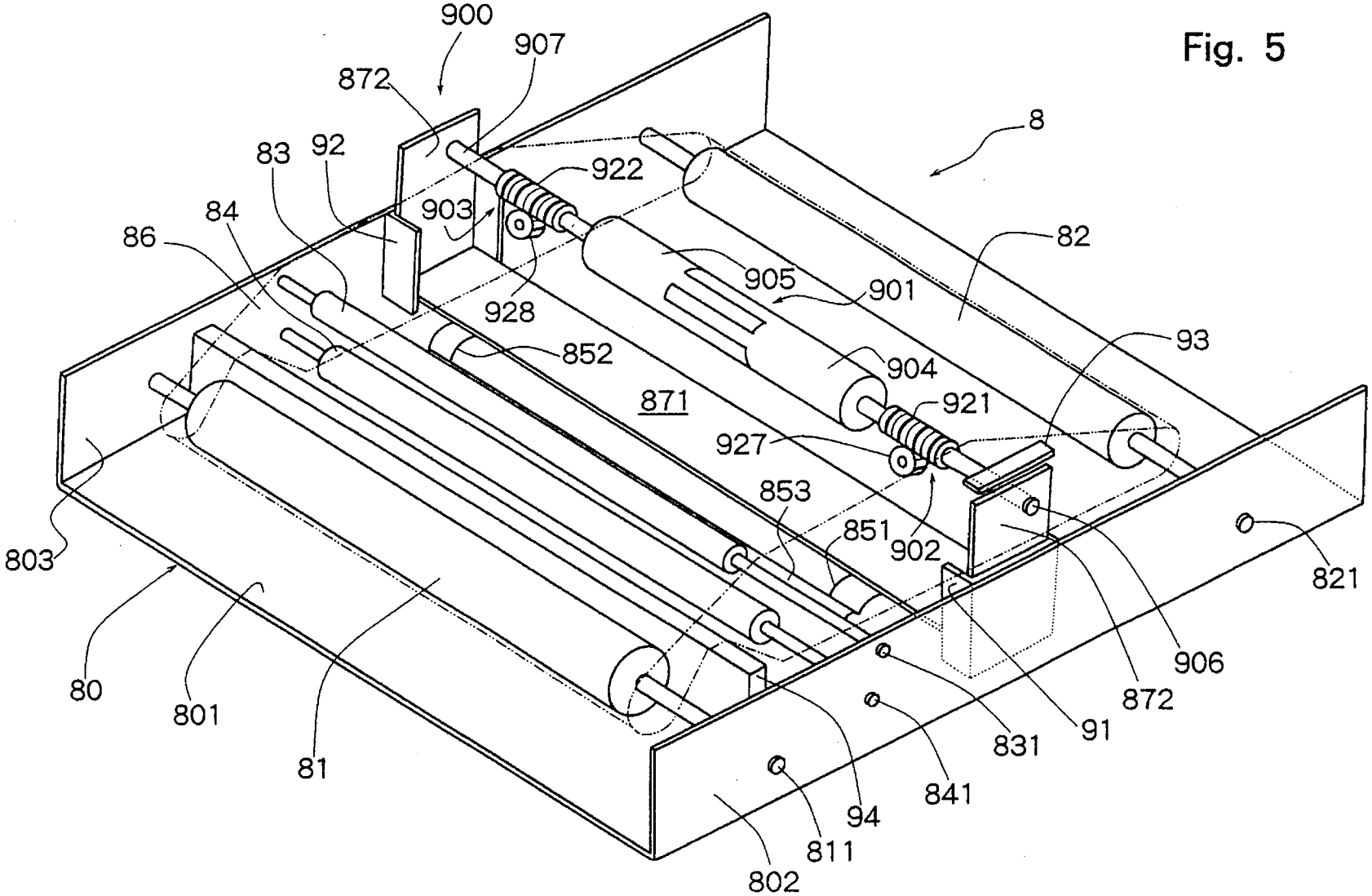
FIG. 5 is a perspective view illustrating the transfer belt unit according to a further embodiment of the present invention employed in the image-forming machine.
Figure 6:
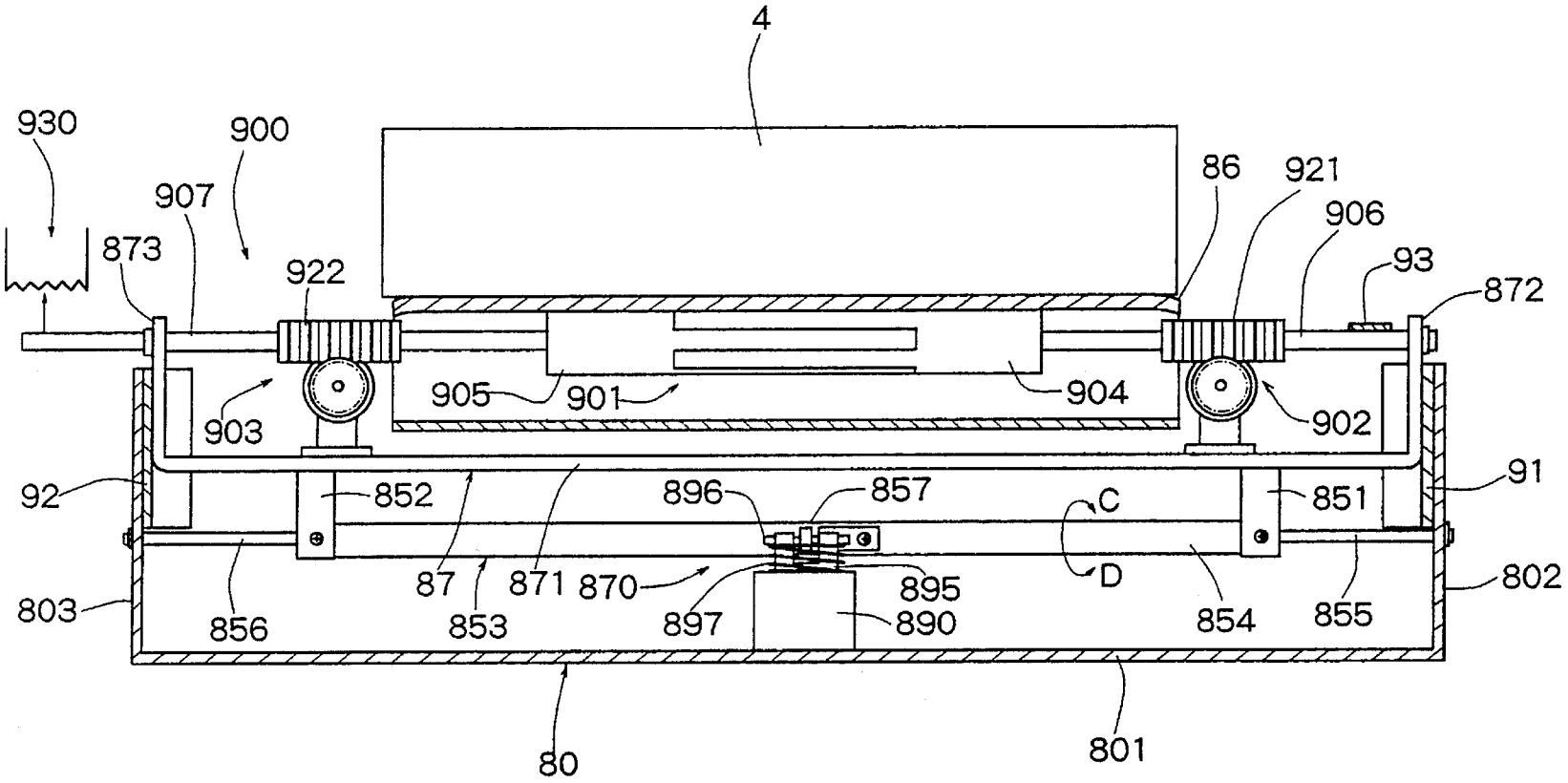
FIG. 6 is a sectional view of major portions illustrating a relationship between the transfer belt unit of FIG. 5 and the image carrier.

Described below with reference to FIG. 4 is another embodiment of the transfer roller unit that constitutes the transfer belt unit of the present invention.

FIG. 4 is a perspective view illustrating another embodiment of the transfer roller unit, wherein the same members as those of the embodiment of FIGS. 2 and 3 are denoted by the same reference numerals and their description is not repeated here. The transfer roller unit 850 according to this embodiment is an improvement of a moving means 870 which moves the transfer roller 88 up and down. The moving means 870 according to this embodiment comprises leaf springs 851 and 852 which are attached, at their ends on one side, to both end portions of the support member 87 that rotatably supports the transfer roller 88, a turn shaft 853 to which the leaf springs 851 and 852 are attached at the ends on the other side, an operation lever 857 mounted at the central portion of the turn shaft 853, and a solenoid device 890 which works as the drive source coupled to the operation lever 857.

The turn shaft 853 has a central portion 854 of a square shape in cross section, and further has both end portions 855 and 856 of a circular shape in cross section. These both end portions 855 and 856 are rotatably supported, via bearings that are not shown, by the side portions 802 and 803 of the unit base plate 80. The solenoid device 890 is mounted on the bottom plate 801 of the unit base plate 80, and the plunger 895 thereof is coupled to the operation lever 857 by a pin 896. The solenoid device 890 has a compression spring 897 disposed between the case and the pin 896. When de-energized, the solenoid device 890 rotates the turn shaft 853 in a direction of arrow C by the action of the coil spring 893 via the operation lever 857, so that the support member 87 is pulled down. When energized, the solenoid device 890 rotates the turn shaft 853 in a direction of arrow D via the operation lever 857 against the force of the compression coil spring 897, so that the support member 87 is pushed up. The rotary shaft 881 of the transfer roller 88 comes into contact with the electrode plate 93 which is connected to the high-voltage power source in a state where the support member 87 is pushed up and the transfer roller 88 mounted on the support member 87 is brought to the transfer position. As described above, when the solenoid device 890 is energized, the moving means equipped with the solenoid device 890, rotary shaft 853 and leaf springs 581 and 852 moves the transfer roller 88 via the support member 87 toward the image carrier 4 up to a first position where the transfer belt 86 is pressed against the image carrier 4 and, when the solenoid device 890 is de-energized, moves the transfer roller 88 in a direction opposite to the image carrier 4 up to a second position where the transfer belt 86 is separated away from the image carrier 4.

According to this embodiment constituted as described above, the support member 87 rotatably supporting the transfer roller 88 is resiliently supported via the leaf springs 851 and 852. In the state of being pushed up by the solenoid device 89, therefore, the pushing force exerted by the transfer roller 88 on the transfer belt 86 and on the image carrier 4 becomes uniform over the full length in the axial direction, making it possible to prevent irregularity in the transfer of image.

Though the foregoing embodiments have employed the solenoid device as a source of driving the moving means for moving the transfer roller up and down, it is also allowable to use any other drive source such as electric motor or the like as well as to use a cam mechanism or a parallel link mechanism as an actuating mechanism.

Described below with reference to FIGS. 5 to 10 is a further embodiment of the transfer belt unit according to the present invention.

The illustrated transfer belt unit 8 comprises a unit base plate 80 secured to a housing that is not shown, of the image-forming machine, a drive roller 81 mounted on the unit base plate 80, a driven roller 82, a guide roller 83, a guide roller 84, a transfer roller unit 900, a moving means 870 for moving the transfer roller unit 900 up and down, and a transfer belt 86 wrapped round the rollers. In the transfer belt unit 8, the members other than the transfer roller unit 900 are substantially the same as the members shown in FIGS. 2 to 4. Therefore, the members which are the same as those shown in FIGS. 2 to 4 are denoted by the same reference numerals and their description is not repeated.

The transfer roller unit 900 comprises a support member 87, a transfer roller 901 mounted on the support member 87, and roller length-changing means 902 and 903 for changing the length of the transfer roller 901 in the direction of axis thereof. The support member 87 has a bottom portion 871 and side portions 872 and 873 that are formed by upwardly bending both ends of the bottom portion 871. The support member 87 is disposed between the guide plates 91 and 92 that are mounted on the inner surfaces of the side portions 802 and 803 of the base plate 80 and that have a channel-shape in cross section, and moves up and down along the guide plates 91 and 92.

Figure 7:
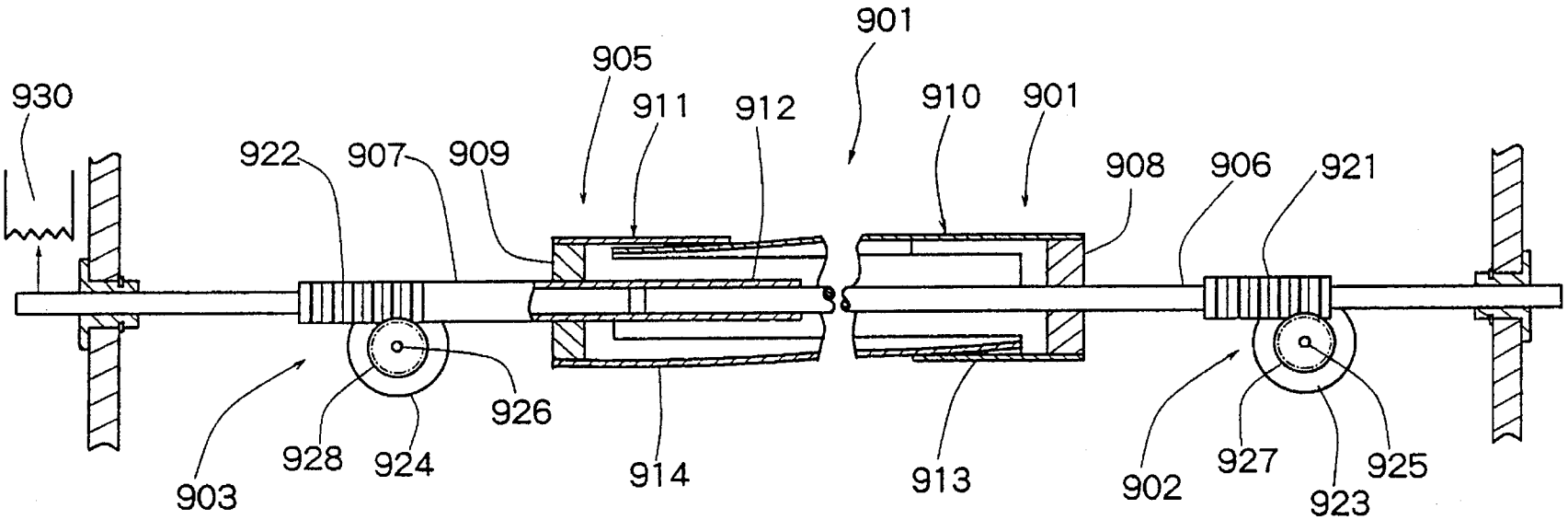
FIG. 7 is a sectional view of major portions of a transfer roller unit that constitutes the transfer belt unit shown in FIG. 5.
Figure 8:
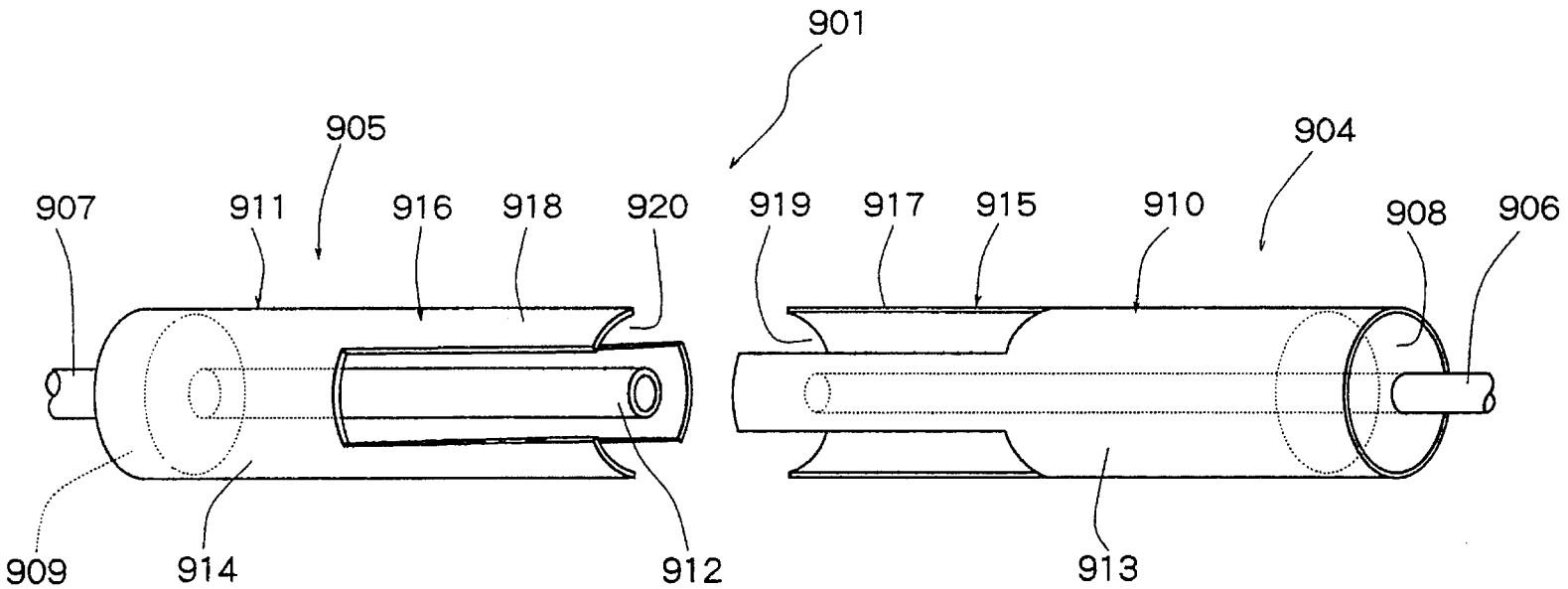
FIG. 8 is a perspective view illustrating, in a disassembled manner, the transfer roller that constitutes the transfer roller unit of the transfer belt unit shown in FIG. 5.

The transfer roller 901 is made up of two rollers 904 and 905 that are arranged on the same axis while being opposed to each other. The rollers 904 and 905 comprise rotary shafts 906 and 907 which are supported at their ends on one side by the side portions 872 and 873 of the support member 87 in a manner to allow to rotate and slide in the axial direction, flanges 908 and 909 mounted on the rotary shafts 906 and 907, and roller portions 910 and 911 of which the ends on one side are secured to the flanges 908 and 909. The other end of the rotary shaft 907 is made up of a cylindrical portion 912 into which the other end of the rotary shaft 906 is slidably inserted. The roller portions 910 and 911 are made of, for example, a spring steel or an electrically conducting rubber fitted to the surface of the spring steel, and are provided with cylindrical portions 913, 914 and engaging portions 915, 916. The engaging portions 915 and 916 have tongue portions 917 and 918 and notch portions 919 and 920. The tongue portions 917, 918 and the notch portions 919, 920 are fitted to each other to constitute the transfer roller 901. The tip portions of the tongue portions 917, 918 are resiliently deformed and are fitted to the inside of the cylindrical portions 913, 914 beyond the engaging portions 915, 916 as shown in FIG. 7, thereby to constitute the transfer roller 901 without gap. The rotary shafts 906 and 907 are provided with racks 921 and 922 that constitute roller length-changing means 902 and 903.

The roller length-changing means 902 and 903 are constituted by reversible motors 923, 924, pinions 927, 928 attached to the drive shafts 925, 296 of the reversible motors 923, 924, and the racks 921, 922. The pinions 927, 928 and the racks 921, 922 are engaged with each other. A potentiometer 930 is disposed at one end of the rotary shaft 907 to detect the roller length of the transfer roller 901, and sends a detect signal to a control unit 100 that will be described later. The roller length-changing means 902 and 903 are so set that even when they are extended to their maximum range, the roller length of the transfer roller 901 is still smaller than the width of the transfer belt 86. This prevents the leakage of electric current from the transfer roller 901 to the image carrier 4.

In the thus constituted transfer roller unit 900, the support member 87 that supports the transfer roller 901 in a manner to allow to rotate and slide in the axial direction is mounted at its both ends on the leaf springs 851 and 852 of the moving means 850. The moving means 850 is constituted in substantially the same manner as the moving means 850 shown in FIG. 4, and the same members are denoted by the same reference numerals and their description is not repeated.

Figure 9:
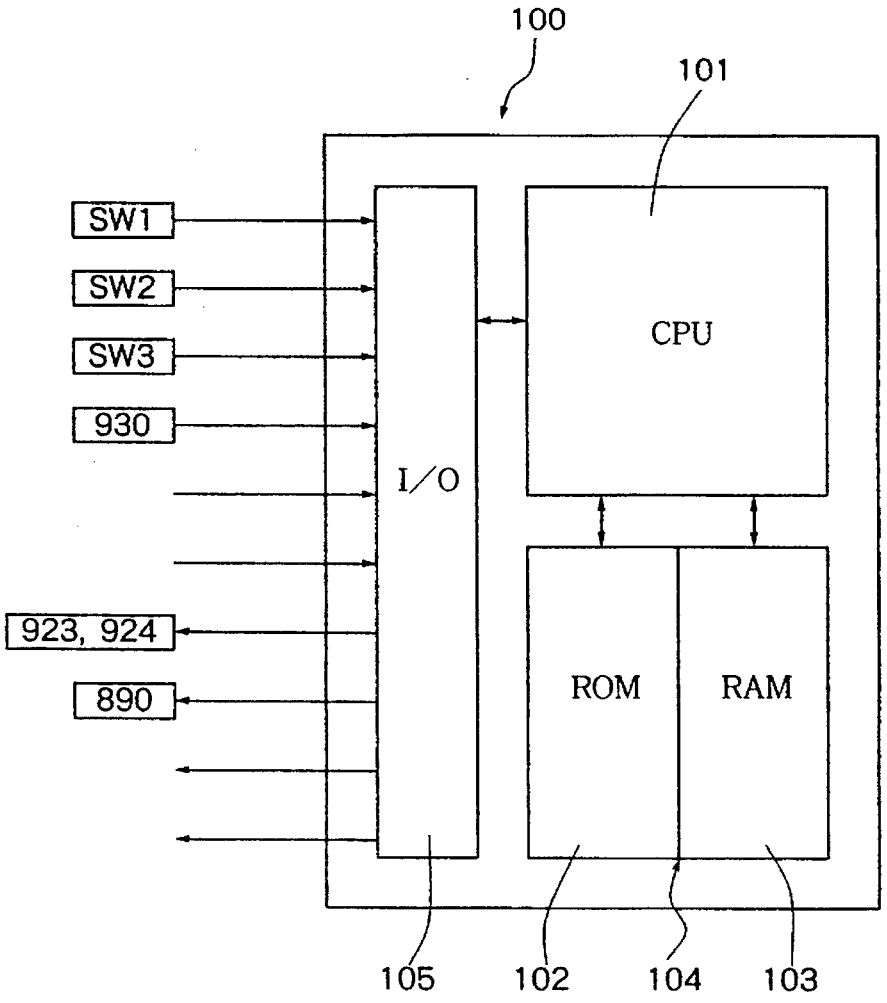
FIG. 9 is a block diagram of a control unit provided in the image-forming machine which is provided with the transfer belt unit shown in FIG. 6.

Next, described below with reference to FIG. 9 is the control unit 100 for controlling the operations of the reversible motors 923, 924 and of the solenoid device 890 in the moving means 850.

The control unit 100 that is shown comprises a central processing unit 101 for carrying out calculation according to a control program, a memory means 104 having a ROM 102 for storing a control program and a random access memory RAM 103 for storing calculation results, and an input/output interface 105. The control unit 100 receives signals from a document size-setting switch SW1, a paper selecting switch SW2, a magnification setting switch SW3 that are arranged on an operation board that is not shown and a signal from the potentiometer 930, and outputs control signals to the reversible motors 923, 924, solenoid device 890 and to other drive sources that are not shown.

Figure 10:
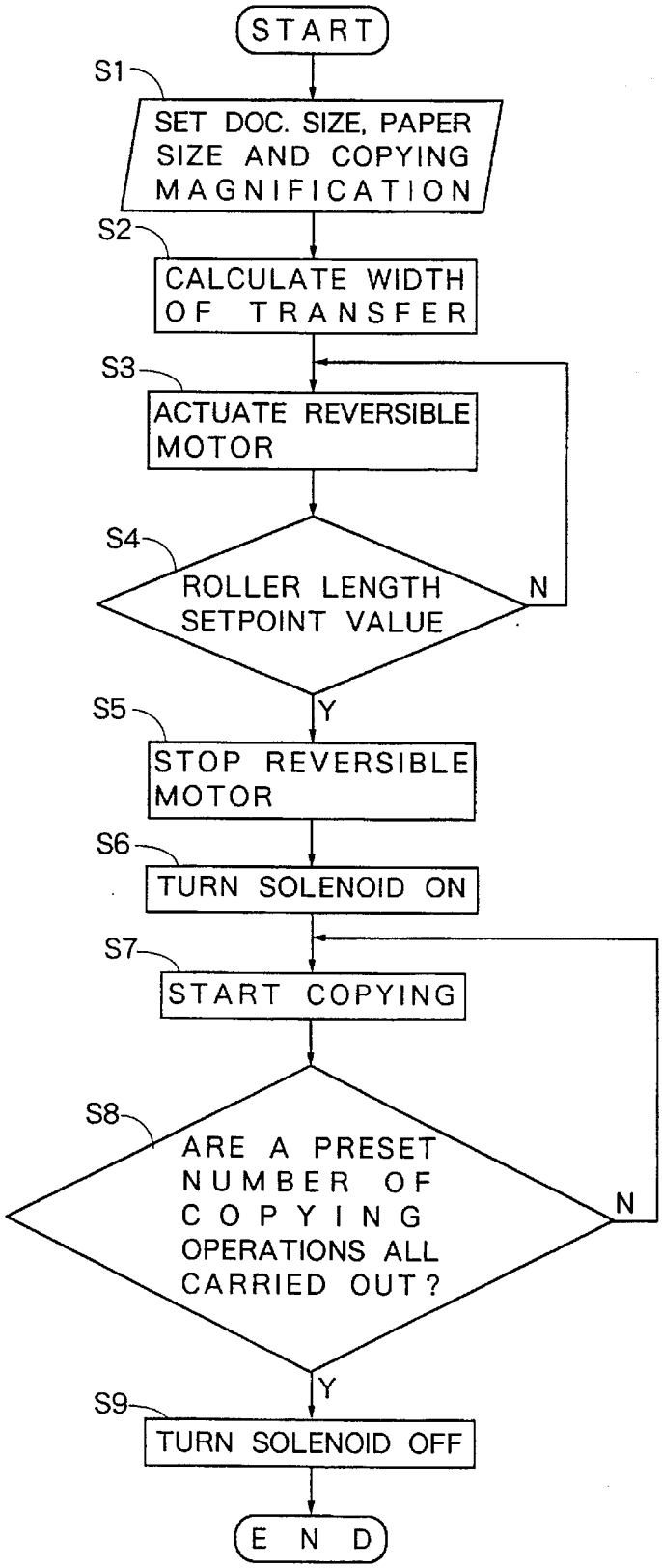
FIG. 10 is a flow chart for explaining the operation of the control unit shown in FIG. 9.

The transfer belt unit according to this embodiment is constituted as described above, and its operation will now be described with reference to a flow chart of FIG. 10.

When a power source switch that is not shown is closed, the control unit 100 operates. Prior to starting the copying operation, the operator inputs the copying conditions such as the document size, size of the transfer paper and copying magnification using the document size-setting switch SW1, paper selecting switch SW2 and magnification setting switch SW3 (step S1). During the copying operation, the document size may be automatically detected, and the size of the transfer paper may be automatically set based upon the detect signal. After the copying conditions are set at the step S1, the control unit 100 calculates the width of transfer (step S2), and the reversible motors 923 and 924 are rotated forward or reverse so that the transfer roller 901 will have a corresponding roller length based upon the calculated width of transfer (step S3). After the reversible motors 923 and 924 are driven, it is checked whether a predetermined value corresponding to the calculated width of transfer is reached or not based upon a detect signal from the potentiometer 930 (step S4). When the detect signal from the potentiometer 930 is not reaching the predetermined value, the reversible motors 923 and 924 are continuously driven. When the detect signal from the potentiometer 930 has reached the predetermined value, the reversible motors 923 and 924 are no longer driven (step S5). After the transfer roller 901 is adjusted to a roller length that corresponds to the width of the transfer paper that is used, the control unit 100 turns the solenoid device 890 on to energize it (step S6). The solenoid device 890 that has been energized rotates the turn shaft 853 in the direction of arrow D via the operation lever 857 against the force of the compression coil spring 897, so that the support member 87 is pushed up via the leaf springs 851 and 852. Thereby, the transfer roller 901 pushes the transfer belt 86 onto the image carrier 4 uniformly over the full length in the axial direction, and thus the copying operation is ready to be started. Then, the control unit 100 proceeds to a step S7 to start the copying operation. That is, the image carrier 4, illumination lamp 14, corona discharger 5 for charging, developer 6, cleaning unit 10, discharging lamp 12, transfer paper feeding unit 26, pair of fixing rollers 42, pair of discharge rollers 44 and transfer belt unit 8 shown in FIG. 1 are actuated to carry out the copying operation. During the copying operation, the rotary shaft 906 of the transfer roller 901 comes into contact with the electrode plate 93 and a high voltage is applied to the transfer roller from the electrode plate 93. When the transfer paper is fed to between the image carrier 4 and the transfer belt 86, therefore, the toner images formed on the surface of the image carrier 4 are sequentially attracted by, and are transferred onto, the transfer paper by the action of the electric charge formed on the transfer roller at the transfer portion where the image carrier 4 and the transfer roller 901 are opposed to each other. The transfer paper to which the toner images have been transferred is conveyed by the transfer belt 86, fixed by the pair of fixing rollers 42 shown in FIG. 1 and is discharged by the pair of discharge rollers 44. The toner adhered to the surface of the transfer belt 86 is removed by the cleaning blade 94 as it travels in the direction of arrow B. When the copying operation is started as described above, the control unit 100 proceeds to a step S8 where it is checked whether a preset number of copying operations has been all carried out or not. When the preset number of copying operations has not yet been all carried out, the copying operation is continued. After the preset number of copying operations has all been finished, the solenoid device 890 is turned off and is de-energized (step S9). When the solenoid device 890 is de-energized, the turn shaft 853 is turned in the direction of arrow C via the operation lever 857 by the action of the compression coil spring 897, and the support member 87 is pulled down. Therefore, the transfer roller 901 mounted on the support member 87 is pulled down and is separated away from the image carrier 4. Then, the tension of the transfer belt 86 is loosened, the contact pressure between the transfer belt 86 and the cleaning blade 98 is removed, and the transfer belt 86 is prevented from being permanently deformed or the cleaning blade 94 is prevented from being deformed since the cleaning blade is not pushing the transfer belt at all times.

The transfer belt unit in the image-forming machine according to the embodiment is constituted as described above, and the control unit drives to control the roller length-changing means 902 and 903 according to the copying conditions to change the length of the transfer roller depending upon the size of the transfer paper that is used. Therefore, the transfer belt of a portion where there exists no transfer paper is not pushed onto the image carrier, and the belt is least contaminated by the toner from the image carrier. Accordingly, a reduced burden is born by the cleaning device, and the cleaning performance is maintained over extended periods of time.

Moreover, the transfer belt unit 8 in the image-forming machine according to this embodiment has a moving means 850 which moves the transfer roller unit 900 toward the image carrier 4 up to the first position where the transfer belt 86 is pushed onto the image carrier 4 and moves the transfer roller unit 900 in a direction opposite to the image carrier 4 up to the second position where the transfer belt 86 is separated away from the image carrier 4. When the transfer operation is not carried out, the transfer roller unit is moved to the second position so that the transfer belt is separated away from the image carrier and that its tension is loosened. Therefore, the contact pressure between the transfer belt and the cleaning blade is removed. Therefore, the transfer belt is prevented from being permanently deformed and the cleaning blade is prevented from being deformed since the cleaning blade is not pushing the transfer belt at all times.

In the illustrated embodiment, the roller length-changing means 902 and 903 were provided for the rotary shafts 906 and 907 of the two rollers 904 and 905 that constitute the transfer roller 901. However, the roller length-changing means may be provided for either one of them only. Furthermore, though the roller length-changing means 902 and 903 were made based upon the rack-and-pinion mechanism, they may employ various operation mechanisms such as worm gear-worm gear mechanism or the like mechanism. When the worm gear-worm gear mechanism is employed, the reversible motors 923 and 924 must be operated in response to the revolution of the transfer roller 88 driven by the transfer belt 86. Moreover, this embodiment has employed the solenoid device 890 as a source for driving the moving means that moves the transfer roller up and down. It is, however, also allowable to use a drive source such as an electric motor or the like and, besides, a cam mechanism or a parallel link mechanism may be used as the operation mechanism for the moving means.

What we claim is:

1. A transfer belt unit in an image-forming machine which comprises a drive roller, a driven roller disposed in parallel with, and spaced from, said drive roller, a transfer belt wrapped round said drive roller and said driven roller, and a cleaning blade disposed, at least when in a cleaning state, in contact with the surface of said transfer belt, and which transfers the toner image formed on an image carrier onto a copying paper that is fed to between said transfer belt and said image carrier and conveys the transfer paper onto which the toner image has been transferred, wherein said transfer belt unit further comprises:

a transfer roller which is opposed to said image carrier with said transfer belt interposed therebetween and is rotatably supported at its both ends by a support member; and a moving means which moves said transfer roller toward said image carrier up to a first position wherein said transfer belt is pushed onto said image carrier member, the transfer belt has tension and the cleaning blade contacts the transfer belt with a pressure suited for cleaning, and said moving means moves said transfer roller in a direction opposite to said image carrier to a second position wherein said transfer belt is separated away from said image carrier, the tension in the transfer belt is loosened and the pressure between the cleaning blade and the transfer belt is removed.

2. A transfer belt unit in an image-forming machine according to claim 1, wherein said moving means pivotally supports said support member at a central portion thereof in the axial direction of the roller.

3. A transfer belt unit in an image-forming machine according to claim 1, wherein said moving means is provided with leaf springs which resiliently support both end portions of said support member.

4. A transfer belt unit in an image-forming machine according to claim 1, wherein said transfer roller has a length in the axial direction thereof, which is smaller than the width of said transfer belt.

5. A transfer belt unit in an image-forming machine according to claim 1, wherein said transfer roller is chamfered at its both end portions.

6. A transfer belt unit in an image-forming machine which comprises a drive roller, a driven roller disposed in parallel with, and spaced from, said drive roller, and a transfer belt wrapped round said drive roller and said driven roller, and which transfers the toner image formed on an image carrier onto a copying paper that is fed to between said transfer belt and said image carrier and conveys the transfer paper onto which the toner image has been transferred, wherein the transfer belt unit further comprises:

a transfer roller unit having a roller support member that is disposed being opposed to said image carrier with said transfer belt interposed therebetween, and a transfer roller made up of two rollers that are supported by said roller support member on the same axis in a manner of being opposed to each other and being allowed to rotate and slide in the axial direction;

a roller length-changing means which moves at least one of said rollers in the axial direction; and a control unit that drives to control said roller length-changing means to accord with the size of the transfer paper at the time of transfer operation.

7. A transfer belt unit in an image-forming machine according to claim 6, wherein the two rollers of said transfer roller are each provided with a rotary shaft, a flange mounted on said rotary shaft, and a roller portion which is secured at its one end to said flange, said roller portion is constituted by a cylindrical portion which is secured at its one end to the flange and an engaging portion having tongue portions and notch portions alternatingly formed in the circumferential direction thereof, and wherein said tongue portions and said notch portions are fitted to each other, and the tip portions of said tongue portions are fitted to the inside of the cylindrical portion beyond the engaging portions.

8. A transfer belt unit in an image-forming machine according to claim 6, wherein said roller length-changing means has such a range of movement that a maximum length of said transfer roller is shorter than the width of said transfer belt.

9. A transfer belt unit in an image-forming machine which comprises a drive roller, a driven roller disposed in parallel with, and spaced from, said drive roller, a transfer belt wrapped round said drive roller and said driven roller, and a cleaning blade disposed in contact with the surface of said transfer belt, and which transfers the toner image formed on an image carrier onto a copying paper that is fed to between said transfer belt and said image carrier and conveys the transfer paper onto which the toner image has been transferred, wherein the transfer belt unit further comprises:

a transfer roller unit having a roller support member that is disposed being opposed to said image carrier with said transfer belt interposed therebetween, and a transfer roller made up of two rollers that are supported by said roller support member on the same axis in a manner of being opposed to each other and being allowed to rotate and slide in the axial direction;

a roller length-changing means which moves at least one of said rollers in the axial direction;

a moving means which moves said transfer roller unit toward said image carrier up to a first position where said transfer belt is pushed onto said image carrier member, and moves said transfer roller unit in a direction opposite to said image carrier up to a second position where said transfer belt is separated away from said image carrier; and a control unit which, when the transfer operation is being carried out, drives to control said roller length-changing means to accord with the size of the transfer paper, drives said moving means so that said transfer roller unit is moved to said first position and, when the transfer operation is not being carried out, drives said moving means so that said transfer roller unit is moved to said second position.

10. A transfer belt unit in an image-forming machine according to claim 9, wherein said moving means has leaf springs for resiliently supporting both end portions of said roller support member.

11. A transfer belt unit in an image-forming machine which comprises a drive roller, a driven roller disposed in parallel with, and spaced from, said drive roller, a transfer belt wrapped round said drive roller and said driven roller, and a cleaning blade disposed in contact with the surface of said transfer belt, and which transfers the toner image formed on an image carrier onto a copying paper that is fed to between said transfer belt and said image carrier and conveys the transfer paper onto which the toner image has been transferred, wherein said transfer belt unit further comprises:

a transfer roller which is opposed to said image carrier with-said transfer belt interposed therebetween and is rotatably supported at its both ends by a support member; and a moving means which moves said transfer roller toward said image carrier up to a first position where said transfer belt is pushed onto said image carrier member, and moves said transfer roller in a direction opposite to said image carrier up to a second position where said transfer belt is separated away from said image carrier, and wherein said transfer roller has a length in the axial direction thereof which is smaller than the width of said transfer belt.

12. A transfer belt unit in an image-forming machine which comprises a drive roller, a driven roller disposed in parallel with, and spaced from, said drive roller, a transfer belt wrapped round said drive roller and said driven roller, and a cleaning blade disposed in contact with the surface of said transfer belt, and which transfers the toner image formed on an image carrier onto a copying paper that is fed to between said transfer belt and said image carrier and conveys the transfer paper onto which the toner image has been transferred, wherein said transfer belt unit further comprises:

a transfer roller which is opposed to said image carrier with said transfer belt interposed therebetween and is rotatably supported at its both ends by a support member; and a moving means which moves said transfer roller toward said image carrier up to a first position where said transfer belt is pushed onto said image carrier member, and moves said transfer roller in a direction opposite to said image carrier up to a second position where said transfer belt is separated away from said image carrier, and wherein said transfer roller is chamfered at its both end portions.

* * * * *